US008276660B2

(12) United States Patent
Bolze

(10) Patent No.: US 8,276,660 B2
(45) Date of Patent: Oct. 2, 2012

(54) DUAL ANCHORING TUBULAR BACK-OFF TOOL

(75) Inventor: Victor Matthew Bolze, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 366 days.

(21) Appl. No.: 12/486,825

(22) Filed: Jun. 18, 2009

(65) Prior Publication Data

US 2010/0319929 A1 Dec. 23, 2010

(51) Int. Cl.
*E21B 19/16* (2006.01)
*E21B 17/02* (2006.01)

(52) U.S. Cl. ..... 166/117.7; 166/377

(58) Field of Classification Search ..... 166/117.7, 166/377

See application file for complete search history.

(56) References Cited

U.S. PATENT DOCUMENTS

| | | | | |
|---|---|---|---|---|
| 2,305,261 | A | 12/1942 | Kinley | |
| 2,947,521 | A | 5/1958 | Tappmeyer | |
| 2,947,520 | A * | 8/1960 | Tappmeyer | 166/117.7 |
| 2,948,059 | A | 8/1960 | Bodine, Jr. | |
| 4,007,790 | A | 2/1977 | Henning | |
| 5,024,272 | A * | 6/1991 | Roessler | 166/117.7 |
| 5,404,944 | A | 4/1995 | Lynde et al. | |
| 5,454,420 | A | 10/1995 | Snider et al. | |
| 5,454,490 | A | 10/1995 | Johanson | |
| 6,752,215 | B2 | 6/2004 | Maguire et al. | |
| 7,195,069 | B2 | 3/2007 | Roberts | |
| 2009/0283322 | A1 * | 11/2009 | Dove | 175/40 |

FOREIGN PATENT DOCUMENTS

| | | |
|---|---|---|
| GB | 2341621 a | 3/2000 |
| WO | 9719248 A2 | 5/1997 |

* cited by examiner

*Primary Examiner* — Giovanna Wright
(74) *Attorney, Agent, or Firm* — Michael Flynn; Jody DeStefanis; Charlotte Rutherford

(57) ABSTRACT

A back-off tool for use in breaking a joint of a tubular disposed in a well. The tool is dual anchoring in nature such that breaking of the joint may be achieved with a degree of precision heretofore unavailable. Additionally, the dual anchoring nature of the tool at both sides of the joint allows for power requirements to be met through use of a dowhole power source incorporated into the tool. As a result, the use of heavier power carrying cables and equipment may be avoided as well as explosives or similarly hazardous and/or imprecise measures.

20 Claims, 5 Drawing Sheets

DUAL ANCHORING TUBULAR BACK-OFF TOOL

FIELD

Embodiments described relate to oilfield well operations. In particular, back-off tools and techniques for separating tubular portions from one another are described. For example, such techniques may be employed for removing an uphole portion of a tubular from the well when a downhole portion thereof has been stuck for any number of reasons. Subsequent fishing operations may thus be employed for removal of the downhole portion of the tubular. The tubular itself may be production tubing, drill pipe or other conventional jointed hydrocarbon tubing.

BACKGROUND

Exploring, drilling, completing, and operating hydrocarbon and other wells are generally complicated, time consuming and ultimately very expensive endeavors. In recognition of these expenses, added emphasis has been placed on monitoring and managing all phases of well completion and production. This may include monitoring and maintaining the positioning and placement of well tubulars within a well. For example, the initial drilling of a well may be achieved through use of a drill bit at the end of drill pipe which serves as a tubular for directing fluid flow during the operation. In another example, a tubular in the form of production tubing may be positioned in the well to serve as a conduit for hydrocarbon recovery therefrom. Regardless of the tubular type, proper monitoring and maintenance thereof may substantially lower the cost of well completion and production in the long run.

Monitoring of such tubulars as noted above often reveals problems with their deployment in the well. For example, problems associated with differential pressure, well architecture, obstructions and other factors often lead to the tubular becoming stuck at a location in a well. In the case of drill pipe, this may lead to a stoppage of drilling whereas in the case of production tubing, this may lead to improper or incomplete positioning for hydrocarbon recovery.

Fortunately, techniques have been developed for reversing or "backing-off" tubulars from within the well when such circumstances arise. These techniques take advantage of the jointed nature of tubulars. That is, tubulars are generally made up of a series of tubular portions that are threadably jointed to one another to form a unitary tubular of extended length. Thus, a technique for tubular removal from a well may include breaking a joint of the tubular that is located immediately above the stuck portion of the tubular. In this manner, the portion of the tubular that is located above the stuck portion may be withdrawn from the well, followed by a conventional fishing operation in order to remove the remainder of the stuck tubular.

Unfortunately, techniques such as those noted above for removing the stuck tubular are often fairly hazardous and imprecise. For example, a technique referred to as "stringshot" is often employed. That is, an explosive charge or "stringshot" is delivered downhole to a location adjacent the joint in order to break the tubular thereat. The stringshot technique is hazardous in that the operator is left handling hazardous explosives. However, it is also a fairly imprecise method of breaking the tubular at exactly the location of the noted joint. That is, the tubular may include a series of joints distanced from one another every 20 to 30 feet or so. Thus, given the inherent imprecise nature of explosives, the use of an explosive charge adjacent the intended joint may lead to the breaking of multiple joints both above and below the intended joint. Furthermore, as a result of uneven corrosion or a host of other factors, the intended joint may be more difficult to dislodge or unscrew than other neighboring joints. Therefore, in many cases, neighboring joints may be broken through a stringshot technique while the intended joint remains intact. All in all, employing the stringshot technique to break a tubular at an intended joint is generally considered to be about a 50-50 prospect.

Given the drawbacks to employing a stringshot technique to break a tubular at a desired joint, some added measures have been developed. For example, with the tubular lifted from surface to a vertically compression-free state and having an unscrewing torque applied thereto, a 'back-off' tool may be deployed into the tubular to the location of the joint of interest. The back-off tool may be configured to anchor to the upper portion of the joint and rotate in the direction of the unscrewing torque imparted from surface. Thus, the remainder of the unscrewing torque necessary to break the joint may be directed directly to the joint via the back-off tool. Furthermore, the exact joint of interest may more assuredly be broken.

Unfortunately, spacing within the tubular is quite limited. For example, a 5 inch diameter tubular is fairly standard for use in a 12 inch diameter well. Therefore, to ensure that sufficient power is provided to the noted back-off tool, a substantial amount of power may be provided from surface as opposed to disposing large amounts of powering equipment into the tubular. This power may be provided by way of a hydraulic line run from surface to the back-off tool, perhaps several thousand feet into the well and tubular. However, employing hydraulics over such a vast distance may be quite cumbersome and expensive, particularly when dealing with wells of extended reach. Thus, as a practical matter, operators today generally elect to bypass use of such a back-off tool in favor of the more hazardous and less precise stringshot techniques as described above.

SUMMARY

A back-off tool is provided for disposing in a well relative to a tubular therein. The tool includes first and second anchors for engaging first and second tubular locations at either side of a joint in the tubular. A downhole powered rotation mechanism of the tool is coupled to the anchors to induce a rotation thereof relative to one another along with each tubular portion.

DETAILED DESCRIPTION

Embodiments are described with reference to back-off applications with respect to certain tubular well operations. In particular, back-off applications as applied to production tubing are described. However, embodiments of back-off tools and applications as detailed herein may be applied to other types of tubing. For example, joints within drill pipe and other tubular varieties may be broken according to techniques described herein. Regardless, back-off tools and techniques employed herein may utilize downhole power by way of straddled dual anchoring at the location of a tubular joint to be broken.

Figure 1:
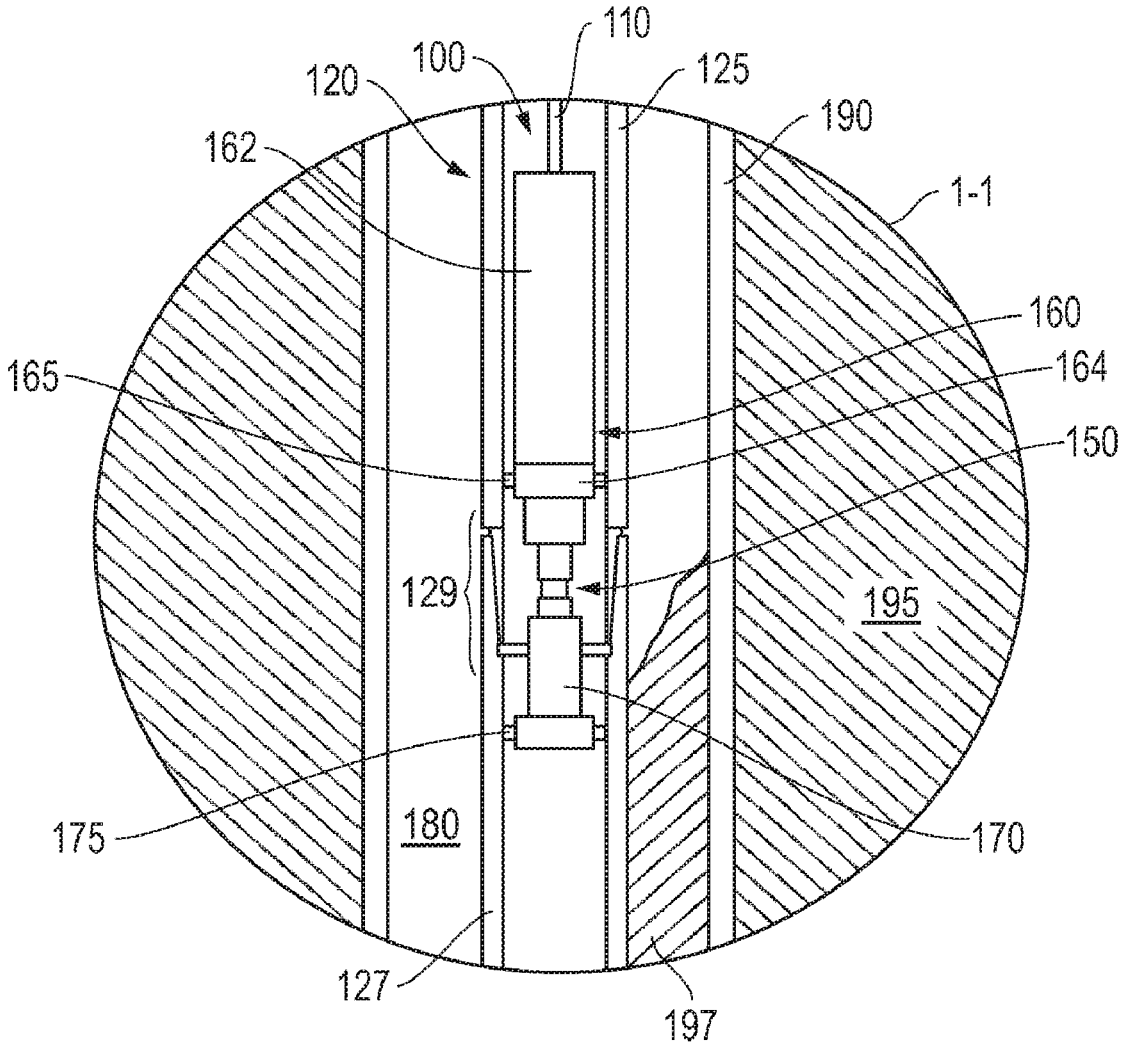
FIG. 1 is an enlarged view of an embodiment of a dual anchor tubular back-off tool taken from 1-1 of FIG. 2.
Figure 2:
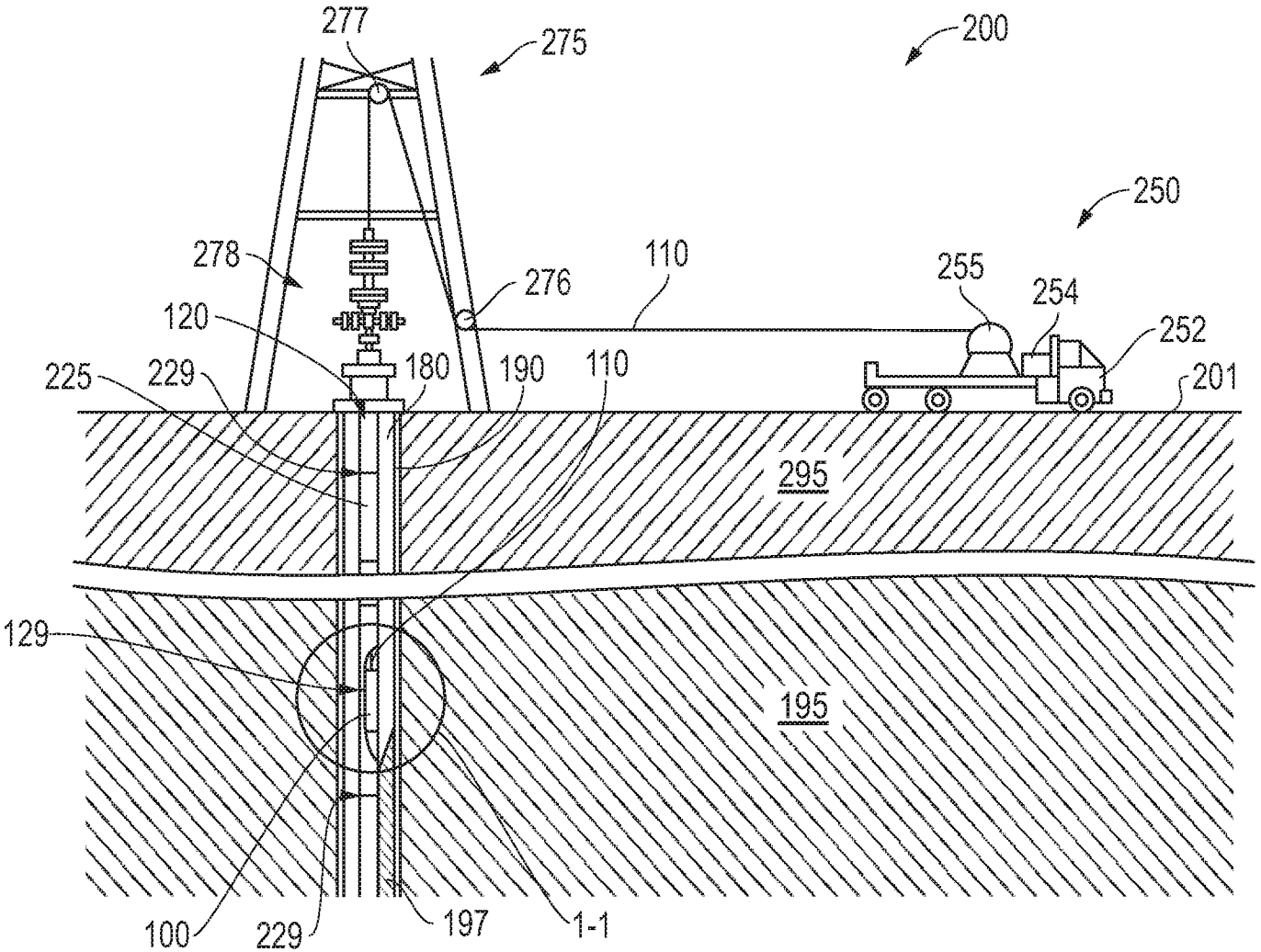
FIG. 2 is an overview of an oilfield revealing employment of the dual anchor tubular back-off tool of FIG. 1.

Referring now to FIG. 1, an enlarged view of an embodiment of a dual anchor tubular back-off tool 100 is depicted taken from 1-1 of FIG. 2. The tool 100 is shown disposed within a tubular 120, which is itself disposed within a well 180. In the embodiment depicted, the tubular 120 is production tubing that has been become stuck by debris 197. The debris 197 has emerged from the surrounding formation 195 to the depicted location interior of the casing 190 of the well 180. As a result, efforts to further deploy or retrieve the tubing 120 in the normal course of operations may be impossible without intervention.

In order to address the situation, an embodiment of the dual anchor back-off tool 100 may be employed to break a targeted joint 129 of the tubing 120. The targeted joint 129 may be located uphole of the sticking point and debris 197 such that its breaking would allow for removal of all tubing 125 thereabove (i.e. 'uphole tubing' 125). Thus, perhaps following a standard clean out of the debris 197, remaining downhole tubing 127 may then be fished out through conventional techniques. As such, production tubing 120 may then be redeployed.

Continuing with reference to FIGS. 1 and 2, breaking of the targeted joint 129 by the back-off tool 100 may be achieved with the tool 100 disposed right at the targeted joint 129. More specifically, the tool 100 is shown engaging or 'anchoring' to both uphole tubing 125 and downhole tubing 127 simultaneously. As detailed further below, this allows for mechanical breaking of the targeted joint 129 with a degree of precision generally unavailable with a more conventional back-off tool. Furthermore, the introduction of explosives, corrosives or heavy powering equipment and techniques may be avoided if so desired.

With particular reference to FIG. 2, an overview of an oilfield 200 is shown with the dual anchor tubular back-off tool 100 deployed in the tubular 120 of the well 180 thereat. As noted, the tubular 120 may be production tubing that has become stuck in the well 180, potentially several thousand feet below formation layers 295, 195. Thus, completion or production operations may be suspended with wireline equipment 250 brought to the oilfield surface 201 in order to guide an intervention with the back-off tool 100. That is, as alluded to above, the tool 100 may be deployed within the tubular 120 for breaking a targeted joint 129 thereof. As such, uphole tubular segments 225 (such as the uphole tubular 125 of FIG. 1) may be readily removed from the well 180. As indicated, this may be followed by a conventional fishing operation to dislodge the remainder of the tubular 120 from the debris 197 or other possible obstruction.

More specifically, the wireline operation and equipment 250 of FIG. 2 may involve the delivery of the back-off tool 100 via wireline 110. The wireline 110 may be a conventional cable with electronic and communicative means incorporated therein. The tool 100 may be coupled to a downhole end of the wireline 110 and deployed from a drum 255 at the back of a standard wireline truck 252. Where access is more of a challenge the wireline 110 may be employed in conjunction with a tractor, drill pipe, coiled tubing and other related assemblies having capacity to aid in conveyance of the tool 100. Additionally, FIG. 2 reveals a control unit 254 provided for directing delivery of the wireline 110 and tool 100. As depicted, the wireline 110 is strung about lower 276 and upper 277 sheaves at a rig 275 positioned immediately over the well 180. The wireline 110 and tool 100 may be threaded through conventional valve and pressure control equipment 278 and into the production tubing 120 for intervention as noted above.

Continuing with reference to FIGS. 1 and 2, the back-off tool 100 is ultimately directed past a variety of tubular segments 225 and non-target joints 229 to the site of the targeted joint 129 to effect its breaking as noted above. More specifically, this breaking may occur at the targeted joint 129 with a degree of precision afforded by the dual anchor nature of the tool 100. That is, as noted above, the tool 100 is configured to simultaneously engage uphole tubing 125 and downhole tubing 127 at either side of the joint 129. To this end, the tool 100 is equipped with an uphole anchor portion 160 and a downhole anchor portion 170. As implied by the names, the uphole anchor portion 160 is configured with uphole anchors 165 for engaging uphole tubing 125 whereas the downhole anchor 170 is equipped with dowhole anchors 175 for engaging downhole tubing 127.

While the anchors 165, 175 are depicted as discrete elements radially extending in a lateral fashion from each anchor portion 160, 170, a variety of anchoring mechanisms may be employed. For example, in an alternate embodiment the discrete anchors 165, 175 may be replaced with vertically oriented anchors configured to span a significant vertical distance at an interface of the anchor portions 160, 170 and the tubing 125, 127. Additionally, in other embodiments, anchoring mechanisms of alternate orientation and/or for supporting a variety of different engaged interfacing with the tubing 125, 127 may be employed.

As depicted in FIG. 1, the uphole anchor portion 160 is equipped with both an anchor housing 164 for accommodating the noted uphole anchors 165 as well as a downhole power housing 162. As detailed further below, the downhole power housing 162 provides a powering mechanism configured to convert power obtained over the wireline 110 into downhole power sufficient to drive a rotation mechanism 150 disposed between the anchor portions 160, 170. In this manner, site-specific breaking of the targeted joint 129 may be achieved without the need of running cumbersome hydraulics all the way from surface.

In the embodiment shown, the joint 129 is made up of the tapered end of uphole tubing 125 mated with an end of the downhole tubing 127. This mating may be maintained mechanically, perhaps with matching threading between each of the ends of the tubing 125, 127. Additionally, natural corrosion and/or introduced adhesive may serve to further the mating between the ends of each tubing 125, 127 at the joint 129. Nevertheless, as detailed below, sufficient power may be converted downhole at the location of the joint 129 so as to effect a break thereof.

With continued reference to FIGS. 1 and 2, the dual anchoring nature of the tool 100 minimizes the amount of power required in order to break the joint 129. However, in order to ensure that the power does not exceed the structural threshold of the tool 100 itself, the tubular 120 may be lifted and torqued to a degree from the surface of the oilfield 200. That is, following, or in conjunction with, the delivery of the tool 100 as depicted in FIG. 2, tension may be applied to the production tubing 120 pulling it upward. This may be employed to substantially eliminate the natural compression present at the joint 129. Indeed, the amount of compression reduced by such an upward pull on the tubular 120 may be quite significant given the potential several thousand feet off tubular 120 above the target joint 129.

In addition to reduction of compression at the joint 129, the tubing 120 may be rotated to a degree at surface. This surface rotation of the tubing 120 may be in a direction opposite the rotation of the downhole anchor portion 170 as directed by the rotation mechanism 150. Ultimately, as detailed below, this may translate to a degree of rotational tension imparted at the joint 129 from surface which is supportive of the actuation of the tool 100 and its rotation mechanism 150. As a result, the amount of downhole power necessary to induce a break in the joint 129 may be kept at a level that avoids self-inflicted damage to the tool 100 through actuation of the rotation mechanism 150. Given the presence of the control unit 254 and the deployment of the tool 100 through communicative wireline techniques, regulating downhole power so as to avoid tool damage as a result of overpowering may be achieved. This is particularly true where, as described here, the likelihood of overpowering is further reduced by lifting and pre-torquing or rotating the tubular 120, so as to minimize the amount of downhole power required to break the joint 129.

Figure 3:
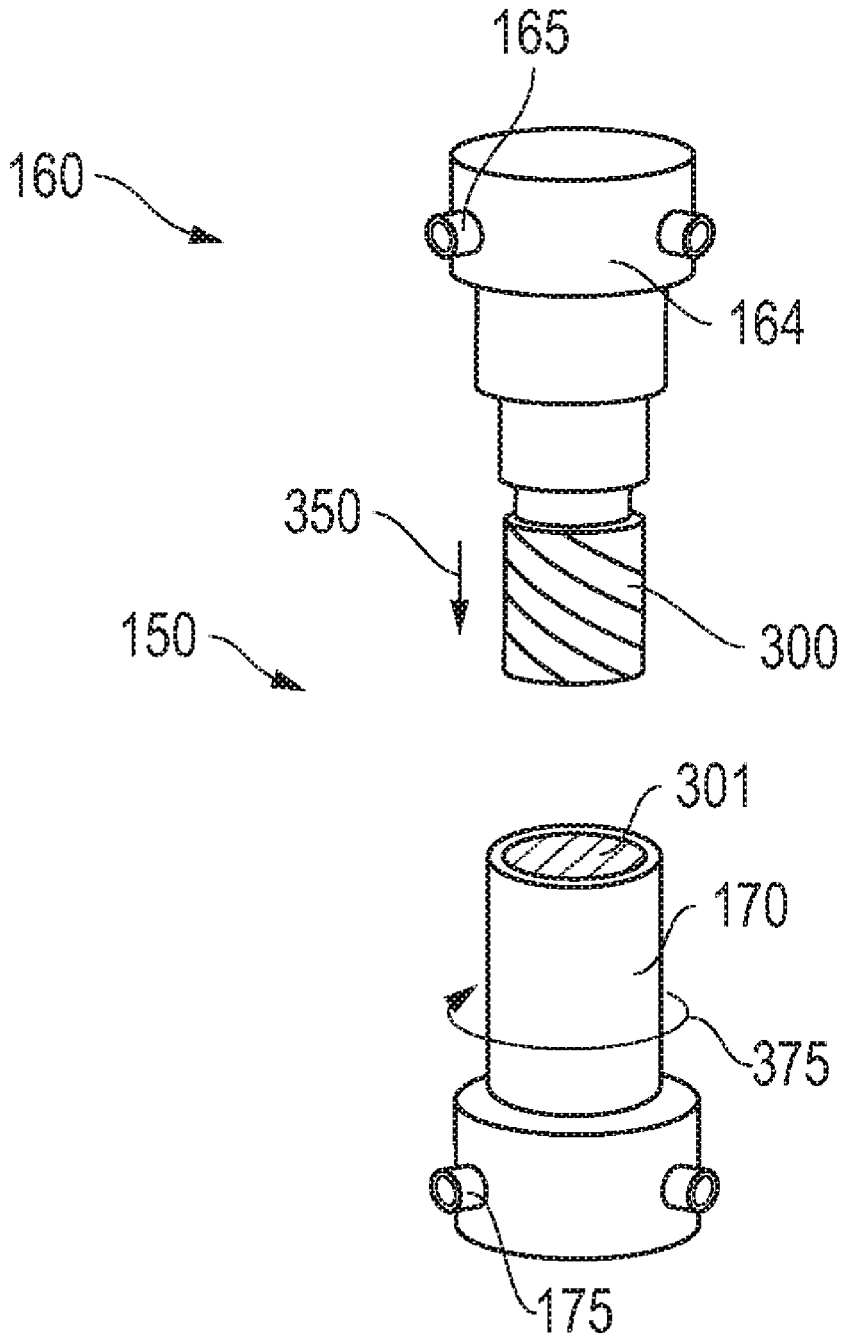
FIG. 3 is an exploded perspective view of an embodiment of a rotation mechanism of the back-off tool of FIG. 1.

Referring now to FIG. 3, with added reference to FIG. 1, an exploded perspective view of the rotation mechanism 150 of FIG. 1 is shown. The rotation mechanism 150 of the back-off tool 100 is configured to direct the rotation between the uphole 160 and downhole 170 anchor portions with respect to one another. For example, see arrow 375 of FIG. 3 indicating a clockwise rotation of the downhole anchor portion 170. It is worth noting, however, that such rotation is relative as between the anchor portions 160, 170. That is, the same mechanics could be represented by way of depicting a counterclockwise rotation of the uphole anchor portion 160. Regardless, such a rotation may be employed to break the joint 129 where the anchors 165, 175 are sufficiently engaged with tubing 125, 127 at either side thereof As indicated above, given the dual anchoring nature of the back-off tool 100 sufficient power for breaking the joint 129 via the rotation noted by arrow 375 may be provided from a downhole source or 'torque generator'. With added reference to FIGS. 4A-4C, this downhole source may include a motor and hydraulic pump assembly 400 housed in the downhole power housing 162 of the uphole anchor portion 160. However, in other embodiments, such a power mechanism may be located elsewhere. Additionally, the power source may avoid use of hydraulics in favor of a motor driven gear train or linear electronic motor. Regardless, the power source may be utilized to direct a downward thrust (i.e. arrow 350) of a piston 300 housed in the uphole anchor housing 164. As described below, this downward action of the piston 300 may be translated to the described rotation between the anchor portions 160, 170.

Continuing with reference to FIG. 3, the piston 300 is configured with a threaded surface and sized for being received by a cavity 301 of the downhole anchor portion 170. However, the interior surface defining the cavity 301 is oppositely threaded relative to the threaded surface of the piston 300. Thus, the downward thrust of the piston 300 into the cavity 301 leads to the interfacing of oppositely oriented threading. As a result of this interfacing, the cavity 301 and the downhole anchor portion 170 are forced into responsive rotation as noted by arrow 375. Again, however, such rotation is relative and may include the rotation of the uphole anchor portion 160 and piston 300 in the opposite direction (i.e. counterclockwise in the embodiment shown). Additionally, while the mismatched interfacing between the piston 300 and the cavity 301 is depicted as a mismatch in the form of helical threading, other types of mismatch interfacing may be employed.

Referring now to FIGS. 1-3, the downward thrust of the piston 300 relative to the uphole anchor housing 164 may be viewed as a distancing between the uphole anchor portion 160 and the downhole anchor portion 170. Further, this distancing is achieved simultaneously with the noted rotation effectuated by the rotation mechanism 150. Thus, with particular reference to FIG. 1, the unscrewing and separating of the uphole 125 and downhole 127 tubing from one another at the joint 129 may be readily envisioned.

Figure 4A:
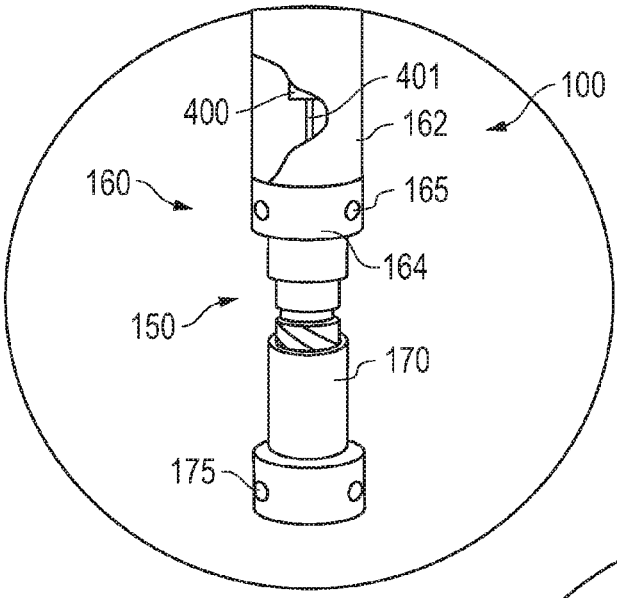
FIG. 4A is a partially sectional perspective view of the dual anchor tubular back-off tool of FIGS. 1-3 in a disengaged position for locating within a tubular.
Figure 4B:
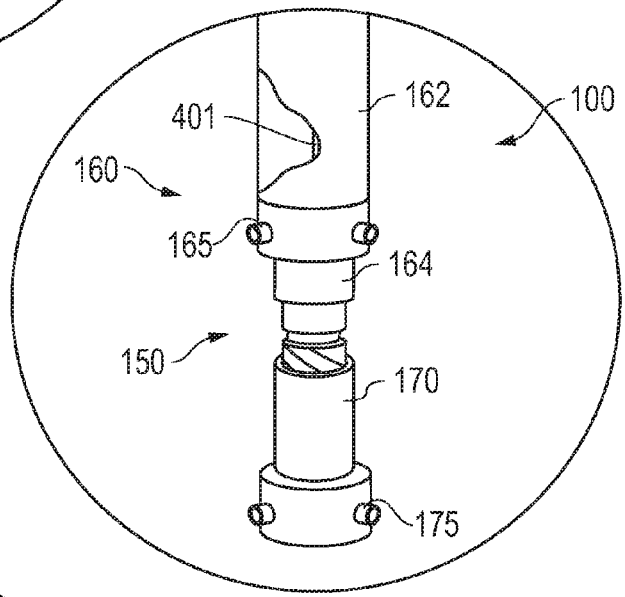
FIG. 4B is a partially sectional view of the back-off tool of FIG. 4A in an engaged position for engaging a tubular.
Figure 4C:
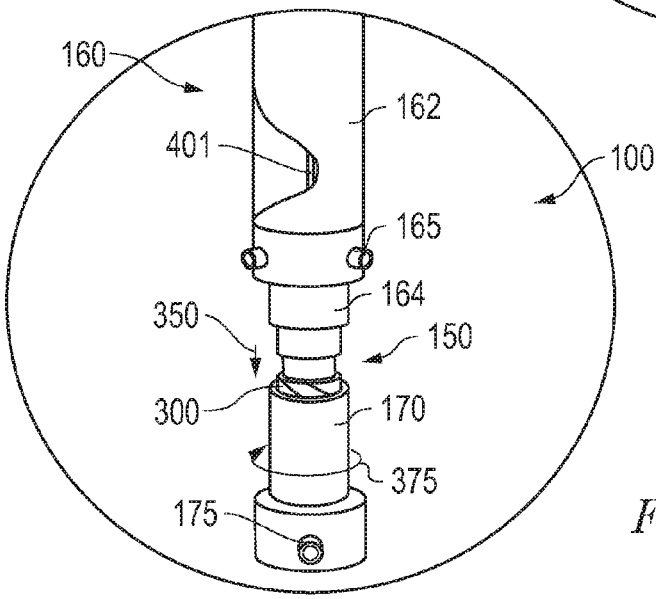
FIG. 4C is a partially sectional view of the back-off tool of FIG. 4B in a rotated position for breaking a joint of a tubular.

Referring now to FIGS. 4A-4C, with added reference to FIGS. 1-3, the mechanics of the dual anchor tubular back-off tool 100 are described in greater detail. Beginning with FIG. 4A, a partially sectional perspective view of the tool 100 is depicted in a disengaged position relative to a tubular 120. That is, the anchors 165, 175 of each anchor portion 160, 170 are depicted in a retracted position. As such, the back-off tool 100 may be of a relatively low profile for advancing through the tubular 120 via wireline 110 or other conventional technique to a location of a targeted joint 129 to be broken.

As noted above, powering of the tool 100 in terms of rotation for breaking the joint 129 may be achieved through a downhole power source such as a motor and hydraulic pump assembly 400. In the embodiment of FIG. 4A, the assembly 400 may be housed within the downhole power housing 162 of the uphole anchor portion 160. As shown, a hydraulic line 401 may be run from the assembly 400 for pressured actuation of the rotation mechanism 150. More specifically, the line 401 may provide the hydraulic pressure for downward actuation of the piston 300 of the mechanism 150 as detailed herein above and with regard to FIG. 4C, described below.

Continuing with reference to FIG. 4B, the anchors 165, 175 are shown radially extended from their respective anchor portions 160, 170. In one embodiment, extension of the anchors 165, 175 in this manner is directed from surface 201 over the wireline 110 utilized in delivering of the tool 100. So, for example, with added reference to FIG. 2, the control unit 254 and/or an operator may direct delivery of the tool 100 to the targeted joint 129 with the anchors 165, 175 in a retracted state as shown in FIG. 4A. Once delivered to the joint 129, the anchors 165, 175 may be actuated for radial extension as shown.

Radially extending and setting the anchors 165, 175 as depicted in FIG. 4B, may be directed over the noted conventional wireline 110. That is, locating the anchors 165, 175 over the targeted joint 129 in a straddled manner as detailed hereinabove may be achieved through conventional positioning techniques. Indeed, even the initial expansion of the anchors 165, 175 may be electrically actuated from surface 201. However, maintaining the anchors 165, 175 in a set state relative to the tubular 120 may be powered by the above described assembly 400. As such, power requirements over the wireline 110 may be kept at a minimum. Furthermore, engaging the tubular 120 through extension of the anchors 165, 175 may serve to signal the motor and pump assembly 400 to increase power output and actuate the rotation mechanism 150 as noted above and with respect to FIG. 4C here below.

Referring now to FIG. 4C, a partially sectional view of the back-off tool 100 of FIG. 4B is depicted in a rotated position. That is, with particular reference to the anchors 165, 175 it is apparent that the downhole anchors 175 are rotated clockwise relative to the uphole anchors 165. This rotation is achieved as detailed above with reference to FIG. 3 and the rotation mechanism 150. Namely, the hydraulic line 401 delivers pressure sufficient to drive a piston 300 of the mechanism 150 in a downward direction (i.e. arrow 350). This vertically downward thrust may be converted to a powered rotation as between the uphole 160 and downhole 170 anchor portions as noted by arrow 375.

In the embodiments described herein, the noted translation of vertical movement to rotation may be achieved through mismatched threading as between the piston 300 and internal dimensions of the downhole anchor portion 170. However, alternate vertical to rotational translating mechanisms may be employed. Regardless, with anchoring of the tubular 120 in mind as shown in FIG. 1, the unscrewing and separating of the uphole 125 and downhole 127 tubing from one another may be readily envisioned upon the rotation effected by the tool 100 as shown in FIG. 4C. In one embodiment, a given rotation powered by the tool 100 may be about 360°. In circumstances where additional rotation is required to achieve breakage of the joint 129, the anchors 165, 175 and piston 300 may be retracted to the positions depicted in FIG. 4A. Thus, subsequent re-anchoring and rotation may be continued until the joint 129 is fully unthreaded and broken.

Figure 5:
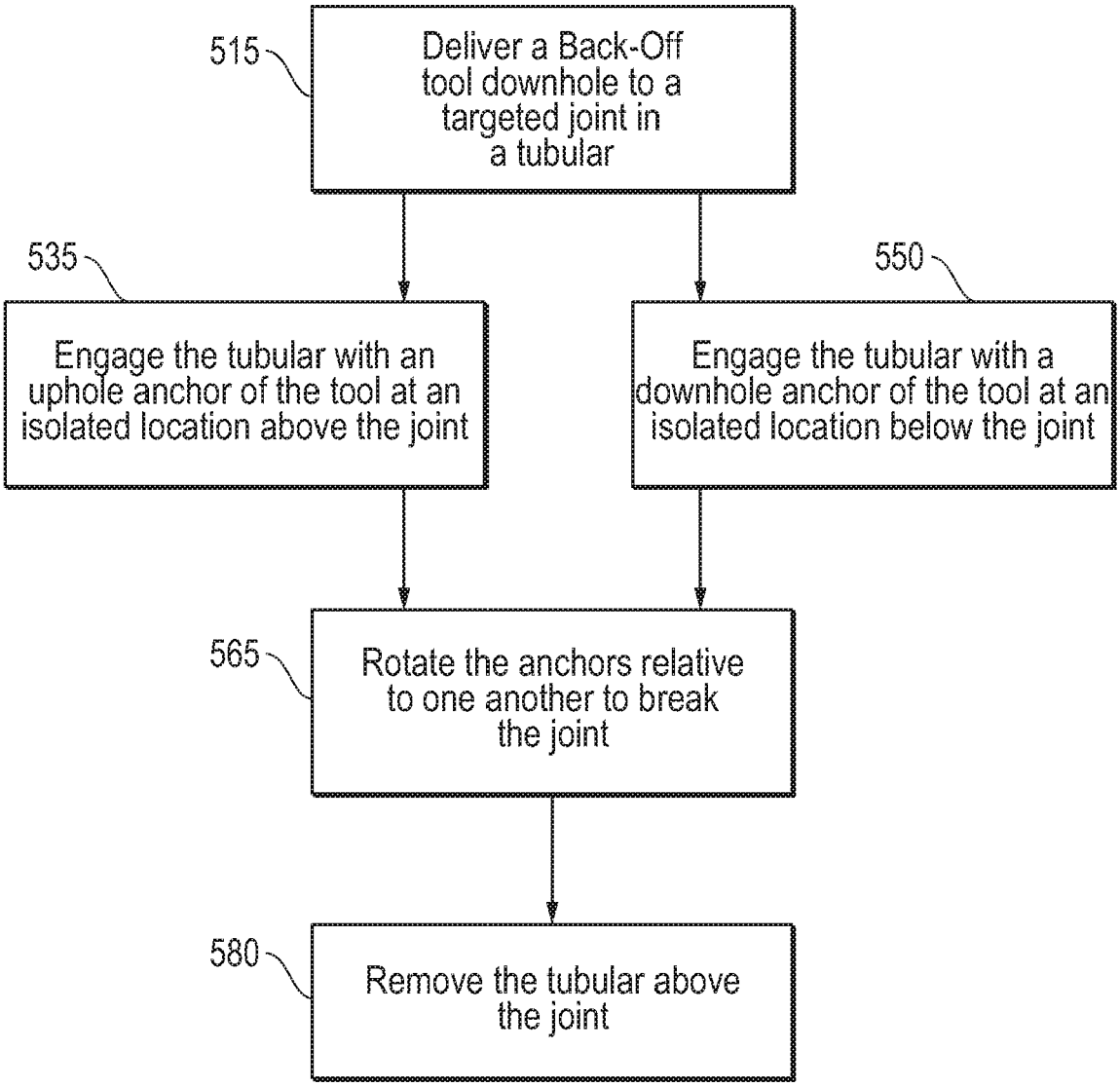
FIG. 5 is a flow-chart summarizing an embodiment of employing a dual anchor tubular back-off tool.

Referring now to FIG. 5, a flow-chart is depicted which summarizes an embodiment of employing a dual anchor tubular back-off tool. As noted at 515, the tool may be delivered within a stuck tubular and advanced to the location of a targeted joint of the tubular, generally just uphole of the stuck location of the tubular (see FIGS. 1 and 2). Once located at the targeted joint, anchors of the tool may be actuated to engage the tubular in a straddled fashion. That is, as indicated at 535 and 550, separate anchors may individually engage the tubular at isolated locations above and below the joint. As such, a downhole powered rotation may be induced as between the anchors so as to break the joint as noted at 565. In one embodiment, this rotation is accompanied by supportive maneuvering of the tubular so as to minimize the likelihood of the tool damaging itself through its own downhole power of rotation. For example, breaking of the joint may be aided by lifting and pre-torquing of the tubular from surface.

Once the joint is broken as described above, the tubular above the joint may readily be withdrawn from the well as indicated at 580. Of particular note, is the reliability with which breaking of the tubular is achieved right at the joint due to the dual anchoring nature of the back-off tool. Thus, the need for multiple break attempts and/or multiple withdrawals of tubing uphole of the targeted joint may be substantially avoided, thereby saving significant time and cost. As such, subsequent fishing and potentially clean out operations may immediately ensue so as to remove the remaining tubular portions and place the well in condition for redeployment of another tubular.

Embodiments detailed hereinabove provide tools and techniques for breaking a downhole tubular at a targeted location without the need for reliance on stringhshot or other potentially hazardous methods. Furthermore, the embodiments described herein include a degree of precision and downhole power capacity such that alternative substantially heavier tool assemblies may similarly be avoided.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments of the back-off tool may be employed for use with tubulars other than production tubing. Such tubulars may include drill pipe as noted, as well as drill collars and casing. Furthermore, the foregoing description should not be read as pertaining only to the precise structures described and shown in the accompanying drawings, but rather should be read as consistent with and as support for the following claims, which are to have their fullest and fairest scope.

I claim:

1. A back-off tool for deployment in a tubular disposed within a hydrocarbon well, the tool comprising:

a first anchor for engaging the tubular uphole of a joint thereof at a first tubular location of a first portion of the tubular;

a second anchor for engaging the tubular downhole of the joint at a second tubular location of a second portion of the tubular; and a downhole powered rotation mechanism coupled to said anchors to induce a rotation of said first anchor and first tubular portion relative to said second anchor and second tubular portion, the downhole power of the rotation mechanism regulated by communication along a wireline extending between the back-off tool and a control unit at an surface of the well.

2. The back-off tool of claim 1 wherein said first anchor is a radially extending uphole anchor and said second anchor is a radially extending downhole anchor.

3. The back-off tool of claim 2 wherein said anchors are configured for radial extension to interface the locations in one of a lateral fashion and a vertical fashion.

4. The back-off tool of claim 1 further comprising an uphole anchor portion with an uphole anchor housing accommodating said first anchor and a downhole power housing accommodating a powering mechanism for said rotation mechanism.

5. The back-off tool of claim 4 wherein the powering mechanism comprises one of a motor and hydraulic pump assembly, a motor driven gear train, and a linear electric motor.

6. The back-off tool of claim 1 wherein said rotation mechanism is a vertical to rotational translating mechanism.

7. The back-off tool of claim 6 wherein said rotation mechanism comprises a piston for vertically extending from the uphole anchor housing of the uphole anchor portion into a cavity of a downhole anchor portion accommodating said second anchor.

8. The back-off tool of claim 7 wherein said piston comprise a first surface with threading of a given orientation, the cavity of the downhole anchor portion defined by a second surface with threading of a mismatched orientation relative to the given orientation for the effectuating upon the vertically extending.

9. The back-off tool of claim 7 wherein said piston is configured for inducing a distancing between the tubular locations upon the vertically extending and a breaking of the joint upon the rotation.

10. The back-off tool of claim 1 wherein the tubular includes one of production tubing, drill pipe, a drill collar, and well casing.

11. The back-off tool of claim 1 wherein the control unit is configured to regulate power provided to the back-off tool in order to avoid overpowering the back-off tool.

12. A back-off tool for deployment in a tubular disposed within a hydrocarbon well, the tool comprising:

an uphole anchor portion for engaging an uphole tubular portion of the tubular;

a downhole anchor portion for engaging a downhole tubular portion of the tubular, the downhole tubular portion interfacing the uphole tubular portion at a joint therebetween;

a rotation mechanism disposed between said anchor portions for guiding a rotation of said downhole anchor portion relative to said uphole anchor portion to break the joint;

a downhole power source comprising a motor and hydraulic pump and disposed in a downhole power housing in the uphole anchor portion, the power source coupled to the rotation mechanism via a hydraulic line disposed between the pump and the rotation mechanism for delivering pressurized power thereto.

13. A method comprising:

delivering a back-off tool, via a wireline, to a targeted joint of a tubular disposed within a hydrocarbon well;

providing electrical power to the back-off tool;

engaging an uphole portion of the tubular uphole of the targeted joint with an uphole anchor portion of the tool;

engaging a downhole portion of the tubular downhole of the targeted joint with a downhole anchor portion of the tool;

rotating the anchor portions relative to one another for breaking the targeted joint; and regulating an amount of power provided to the back-off tool.

14. The method of claim 13 wherein said rotating is powered by a downhole power source coupled to the anchor portions.

15. The method of claim 13 wherein said rotating is guided by a vertical to rotational translating mechanism disposed between the anchor portions.

16. The method of claim 13 wherein said rotating comprises:

rotating the anchor portions from initial positions to rotated positions relative to one another;

disengaging from said engaging;

returning the anchor portions to the initial positions; and repeating said rotating.

17. The method of claim 13 further comprising:

withdrawing the uphole portion of the tubular following said rotation; and employing a fishing application for removal of the downhole portion of the tubular.

18. The method of claim 13 further comprising:

applying uphole lift to the tubular from a location adjacent the well at a surface of an oilfield to impart a substantially vertically compression-free condition at the targeted joint; and applying rotation torque to the tubular from the location to enhance said rotating for the breaking.

19. The method of claim 18 wherein the rotational torque is in a rotational direction opposite the downhole anchor portion during said rotating.

20. The method of claim 13 wherein regulating comprises communicating between the back-off tool and a control unit at a surface of the well to avoid overpowering the back-off tool.

* * * * *